United States Patent [19]

Carson

[11] 4,088,185

[45] May 9, 1978

[54] MOLDED PLASTIC PARAFFIN SCRAPERS AND CENTRALIZERS

[75] Inventor: Forrest Leon Carson, Houston, Tex.

[73] Assignee: J. M. Huber Corporation, Locust, N.J.

[21] Appl. No.: 713,154

[22] Filed: Aug. 10, 1976

Related U.S. Application Data

[63] Continuation of Ser. No. 532,659, Dec. 13, 1974, abandoned, which is a continuation of Ser. No. 387,567, Aug. 10, 1973, abandoned.

[51] Int. Cl.[2] ..... E21B 37/02

[52] U.S. Cl. ..... 166/176; 166/241; 15/104.16; 264/259

[58] Field of Search ..... 166/170–176, 166/241; 308/4 A, 4 R; 15/101, 104.09, 104.1, 104.16; 264/272, 259

[56] References Cited

U.S. PATENT DOCUMENTS

| | | | |
|---|---|---|---|
| 349,192 | 9/1886 | Woodhouse | 308/4 A |
| 2,934,792 | 5/1960 | Harrington | 264/272 |
| 2,975,487 | 3/1961 | Williams, Jr. | 264/272 |
| 2,990,582 | 7/1961 | Tully et al. | 264/259 X |
| 2,997,106 | 8/1961 | Tripplehorn | 166/176 |
| 3,063,760 | 11/1962 | Gifford | 308/4 A |
| 3,083,772 | 4/1963 | Tripplehorn | 166/176 |
| 3,277,966 | 10/1966 | Ward | 166/176 |
| 3,282,345 | 11/1966 | Tripplehorn | 166/176 |
| 3,332,133 | 7/1967 | Rye | 308/4 R |
| 3,364,998 | 1/1968 | Sable | 166/175 |

FOREIGN PATENT DOCUMENTS

| | | | |
|---|---|---|---|
| 800,390 | 12/1968 | Canada | 166/176 |

*Primary Examiner*—Stephen J. Novosad
*Attorney, Agent, or Firm*—Harold H. Flanders

[57] ABSTRACT

A molded plastic scraper is molded in place on the sucker rod and as a result of shrink fitting of the material is firmly held in place thereon. Special configurations and materials particularly useful as and in both scrapers and centralizers are disclosed as well as additional unexpected advantages of such scrapers, configurations, and materials. A preferred method and apparatus for the production and manufacture of such scrapers and centralizers are also disclosed.

8 Claims, 23 Drawing Figures

FIG.1.
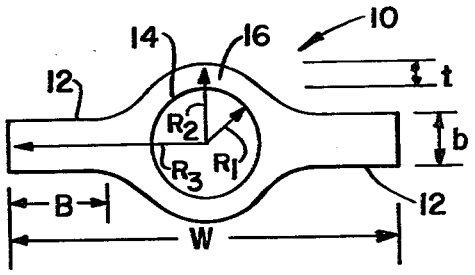
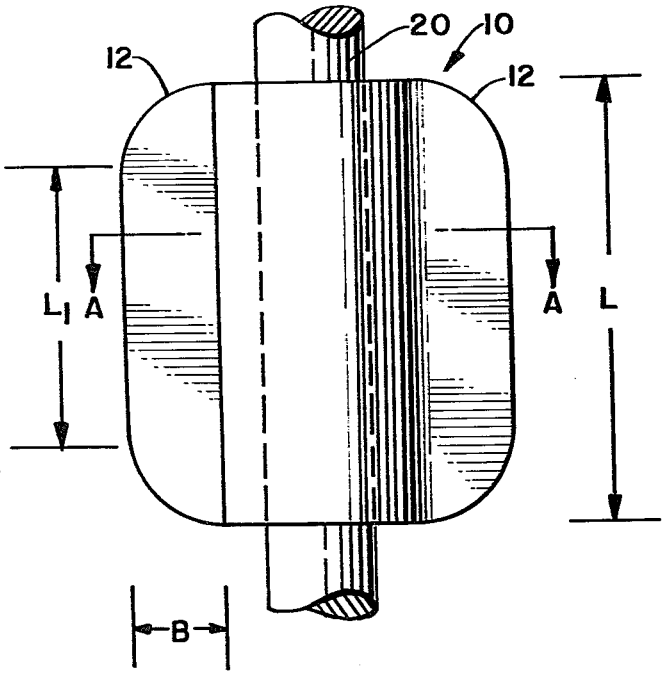
FIG.2.
FIG.4.
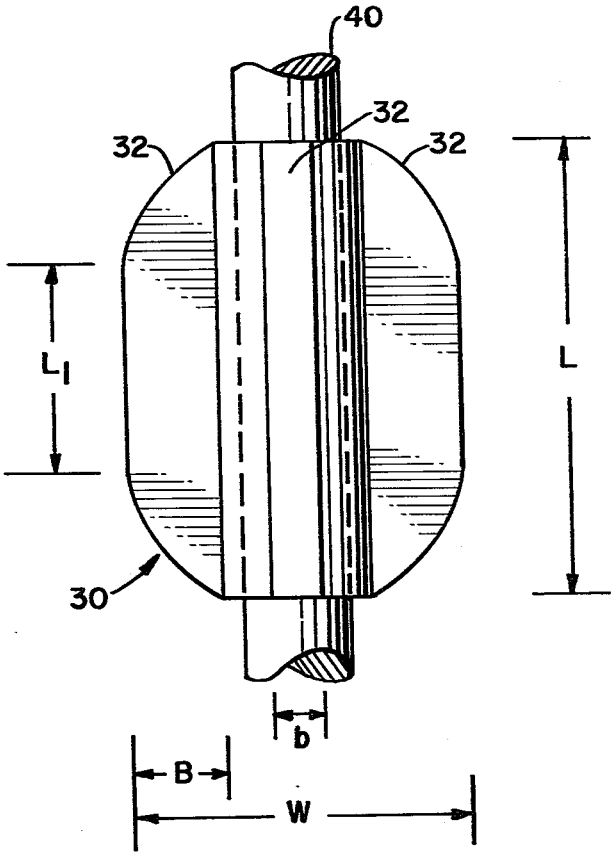
FIG.3.
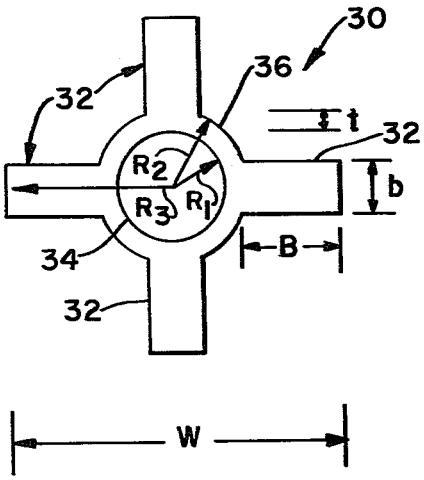

MOLDED PLASTIC PARAFFIN SCRAPERS AND CENTRALIZERS

This is a continuation, of application Ser. No. 532,659, filed Dec. 13, 1974, now abandoned, which is a continuation of Ser. No. 387,567, filed Aug. 10, 1973, now abandoned.

BACKGROUND OF THE INVENTION

This invention relates to paraffin scrapers for oil wells and particularly to a novel type of paraffin scraper consisting of one or more molded plastic paraffin scraper blades, molded in place around a sucker rod and the mode of securely fastening the same to a sucker rod.

An oil well generally comprises a casing, a string of smaller steel pipe inside the casing and generally known as the tubing, a pump at the bottom of the well, and a string of steel rods, commonly referred to as sucker rods, within the tubing and extending down into the pump for operating the pump. Various devices as are well known in the art are provided at the top of the well for reciprocating the sucker rod to operate the pump.

In many cases, the means for reciprocating the sucker rods include devices for rotating the rods through a predetermined angle during each stroke of the sucker rods. Suitable apparatus of this character are shown by Sargent in U.S. Pat. No. 1,653,510; Poulson in U.S. Pat. No. 2,180,880; and McConahey et al. in U.S. Pat. No. 2,444,842; as well as by Johnston in U.S. Pat. Nos. 2,280,408 and 2,318,315.

The crude oil generally contains paraffin and other substances which tend to congeal and precipitate out of the oil and deposit upon the walls of the tubing during the passage of the oil through the tubing. Such deposits are quite objectionable and tend to restrict the flow of oil through the tubing. Various means and methods have been proposed for preventing the formation of such deposits and for removing deposits so formed. Such means and methods comprise the use of chemicals, electrical heating and various mechanical scraping devices. In general, such means and methods are expensive and have other objectionable features.

A common mode of preventing the formation of deposits on the tubing and removing such deposits as they are formed, comprises attaching mechanical paraffin scrapers to the sucker rod. Such sucker rods remove the deposits from the oil well tubing as it is formed so that it is flushed out of the well with the oil passing therethrough.

During and from the beginning of the post-World War II period, significant developments were made in the attachment of scrapers to sucker rods.

C. E. Blackburn in U.S. Pat. No. 2,321,275 disclosed a simple solution for the then-existing problem in the form of an inexpensive detachable scraping blade for sucker rods which are simultaneously reciprocated and rotated. While such scraper blades of Blackburn were commercially successful, it ultimately became apparent that it was difficult to fasten the blade to the sucker rod sufficiently firmly and there was consequently a tendency for the blade to become loose in operations extending over long periods of time.

R. C. Lister in U.S. Pat. No. 2,468,503 disclosed an improved method for attaching scraper blades of the type disclosed by Blackburn to the sucker rod. While the method of Lister was also commercially successful, it required special welding operations in order to attach and secure the blades to the rod.

A further improvement to scraper blades of this type was developed by the inventor of this application, F. L. Carson, and is disclosed in U.S. Pat. No. 2,631,674.

Subsequent improvements were disclosed by Winegar in U.S. Pat. No. 2,979,133 and by Dunham in U.S. Pat. No. 3,106,962. Other notable developments in this technology include Donaldson's disclosure in U.S. Pat. No. 2,237,863 and Besse's disclosure in U.S. Pat. No. 3,156,286.

Paralleling these developments in metal bladed scrapers as early as 1937, attempts were made to develop related sucker rod guides, guards, stabilizers and scrapers from rubber or plastic materials. As disclosed by Anderson in his U.S. Pat. No. 2,153,787, these attempts often resulted in the rubber softening and swelling with the consequent result that the rubber member slipped on the rod and ultimately required replacement. Anderson proposed a solution in the form of a gamma polyvinyl chloride with a soluble plasticizer which upon extraction from the polyvinyl chloride resulted in its gripping the rod more firmly. Notwithstanding this development, a completely satisfactory solution in the form of rubber or plastic scrapers has never found substantial commercial success insofar as known by the applicants.

The multitude of reasons which may be responsible for the failure of such devices to obtain commercial success is no doubt only partially known to the applicants. However, as early as 1961, the applicant and his co-workers within assignee company undertook the development of various rubber and plastic scrapers including compositions formed from Buna N, polyurethane, poly-propylene, acrylonitrile and phenolic blends. In addition to material examination, various bonding means, adhesives, clamping devices, shrink fittings and other more sophisticated techniques were studied in detail. In general, it was found impossible to achieve the desired wear and service characteristics and/or to effectively and economically attach such scrapers to the sucker rod. As a result of these consistent failures, efforts to produce a rubber or plastic scraper were largely abandoned and lay dormant for a number of years prior to the present invention.

The attempts and efforts of others to find a suitable solution to the desire and need for a plastic or rubber scraper are detailed in the following U.S. Pat. Nos.: 2,402,223; 2,436,994; 2,572,307; 2,651,199; 2,693,986; 2,725,621; 2,810,143; 3,079,998; 3,186,773; 3,251,418; 3,414,337; 3,484,141; 3,528,499; 3,537,519; 3,560,060; and 3,537,519.

In addition to the various approaches noted above, a large number of patents have issued to J. C. Tripplehorn on plastic slotted spiral scrapers which are variously snapped on to a sucker rod. For example, see U.S. Pat. Nos. 2,928,472; 2,928,473; 2,969,115; 2,997,106; 2,870,845; 3,058,524; 3,083,772; 3,282,344; and 3,282,345.

A somewhat more recent development involves scrapers of a ball or dumbbell configuration for cleaning short radius of curvature sections. These also have generally been formed from plastic, rubber, or other resilient materials.

While many of the above patents have no doubt found specific application, none has provided the combination of elements to lead to its general utilization.

Insofar as it is possible to generalize, the prior art has failed to provide a scraper having wear characteristics superior to the characteristics possessed by the post-World War II metallic scrapers and the desired reliability and security of attachment to the sucker rod to prevent the paraffin scraper from becoming a significant part of the problem in the course of prolonged service as opposed to the desired solution to the paraffin problem.

SUMMARY OF THE INVENTION

Accordingly, it is an object of the present invention to provide a new and highly effective paraffin scraper and method for attaching of the same to the sucker rod which overcomes the deficiencies of the prior art as described above.

Other objects and a fuller understanding of the invention may be had by referring to the following description and claims taken in conjunction with the accompanying drawings.

The present invention overcomes the deficiencies of the prior art and achieves its objectives by the molding of a plastic scraper in place at one or more positions on a sucker rod whereby, as a consequence of the shrinkage of the fit and swelling of the material, a frictional grip of sufficient force to hold the scraper firmly in place under normal operating conditions is obtained with no damage or induction of stress to the sucker rod.

BRIEF DESCRIPTION OF THE DRAWINGS

In order to facilitate the understanding of this invention, reference will now be made to the appended drawings of preferred embodiments of the present invention. The drawings should not be construed as limiting the invention, but are exemplary only. In the drawings:

FIG. 1 is a cross-sectional representation along cut line AA of FIG. 2.

FIG. 2 is a side view of the molded scraper of the present invention.

FIG. 3 is a top view of a particularly preferred embodiment of the present invention.

FIG. 4 is a side view of the particularly preferred embodiment of the present invention.

DESCRIPTION OF THE PREFERRED EMBODIMENTS

Figure 5:
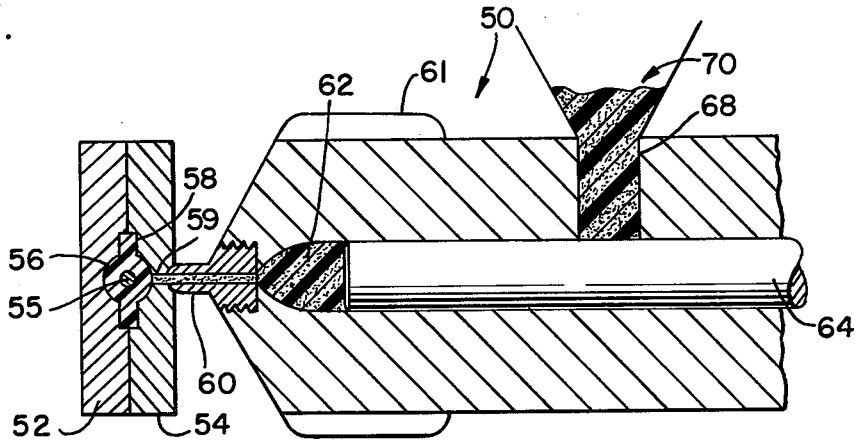
FIG. 5 is a cross-sectional view in schematic representational form of a portion of a typical injection molding machine showing the process of molding a scraper around a sucker rod in accordance with the present invention.

Referring to the drawings in detail and initially to FIGS. 1 and 2 thereof, it will be seen that a molded plastic scraper in accordance with the present invention and generally indicated at 10 consists of a molded plastic body 16 which has been molded around a sucker rod 20 to have tight frictional gripping surface at the boundary 14 therewith. Such a scraper further has one or more blades 12 extending a distance B from the main body of molded material which has a minimum thickness of *t*. The blade has a radius $R_3$ which is sufficiently large to place it in nominal contact with the tubing, assuming the rod to be centered, if only one blade is employed, or where $R_3$ is nominally one-half the total width of the scraper which is nominally equal to the diameter of the tubing. The scraper has a total length L and a length of scraping edge $L_1$.

As especially preferred embodiment of the present invention is shown in FIGS. 3 and 4 wherein a scraper generally indicated at 30 is seen to consist of four blades 32 extending a distance B from the main portion of the molded body and having a thickness *b*. Blades 32 are disposed at right angles about a molded body of plastic material 36 formed around and frictionally gripping sucker rod 40 at the boundary 34. Again the scraper length is designated L and the actual scraping edge $L_1$. It also again is true that the total width of the scraper W is nominally equal to the diameter of the tubing and is twice the blade radius $R_3$. The thickness of the molded material 36 at its thinnest point, disregarding tapering at the end of each scraper, is *t* which is the difference of $R_2 - R_1$.

The significance of each of these dimensions will be referred to in greater detail later in the specification.

At the present point in the description of the present invention it is believed expedient to focus attention upon the general method of producing scrapers and centralizers in accordance with the present invention.

The general method employed is shown in a highly schematic fashion in FIG. 5, which represents a typical injection molding machine 50. As is generally known, such machines generally consist of a moveable platen 52 which holds one-half of the mold 56 or such other appropriate portion thereof as may be necessitated by the particular mold design. Typically, the other half of the mold 58, or appropriate portion thereof, is mounted upon a fixed platen 54. The fixed platen 54 has appropriate orifices 59 to the central portion of the mold to allow injection of a plastic from and through an injection nozzle 60.

In typical operation, a plastic material 68 placed in a feed hopper 70 is fed to a central cylinder 62 wherein it may be moved forward by a plunger 64 to a heated pressure cylinder where it may be heated in the pressure cylinder surrounded by a heating jacket 61 after which the fluid material is injected into the closed mold cavity through nozzle 60 and orifice 59.

While FIG. 5 shows such injection molding with ram extrusion, it is well known that screw extrusion may also be employed.

As such, the details of injection molding as employed in the art are well known and, except as expressly noted herein, do not constitute a part of the present invention. A good description of the operation and detailed construction of injection molding equipment may be found in *Manufacturing Processes* by S. E. Ursinoff, copyright by the American Technical Society, 1962, beginning at page 56. Further technical detail on the specific technology of injection molding as adapted to specific equipment, processes and materials may be found in the publication entitled "Toshiba Injection Molding Machine" designated 10000-01-TED-01 distributed by Sales International of Bell, California.

It is to be thus particularly noted from FIG. 5 that the mold is so constructed as to allow the fluid plastic material to be injected around and molded onto the sucker rod designated 55 which is in the central portion of the mold cavity during the molding process. As a result of such molding by the injection process which assures that the fluid plastic material is forced into all regions of the mold cavity and thoroughly surrounds the sucker rod 55, it is possible to mold a plastic scraper onto a sucker rod to provide a maximum frictional gripping force on the rod sufficient to hold the scraper firmly in place without inducing stress in the sucker rod itself as a result of shrinkage in the plastic material itself which is typically on the order of 0.015 inch per inch. This frictional grip resulting from a unitary structure which has great integrity assures that there will be no damage to the sucker rod and no components such as fasteners, and the like, which may become disengaged and get into or otherwise damage the pumps and flow lines.

Figure 6:
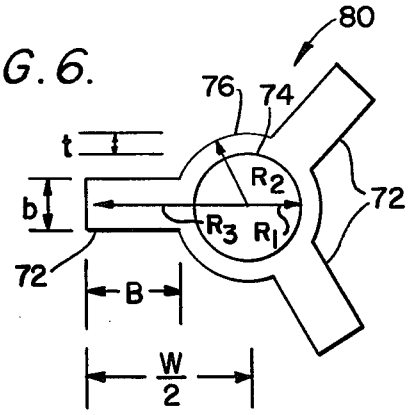
FIG. 6 is a top view of another embodiment of the present invention.
Figure 7:
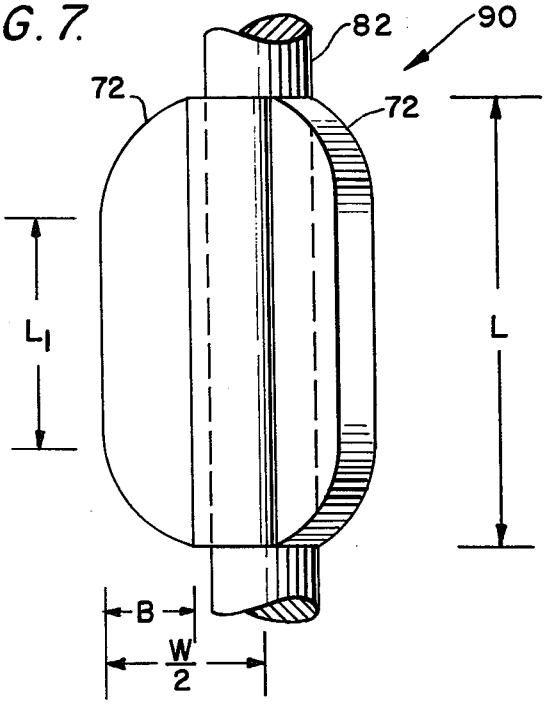
FIG. 7 is a side view of the embodiment of FIG. 6 of the present invention.
Figure 9:
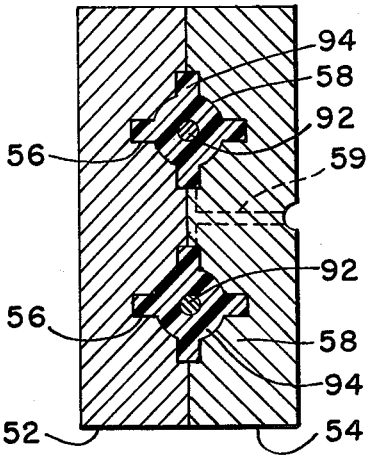
FIG. 9 shows the moveable platen in a closed position around the sucker rod with the plastic material being injected.
Figure 10:
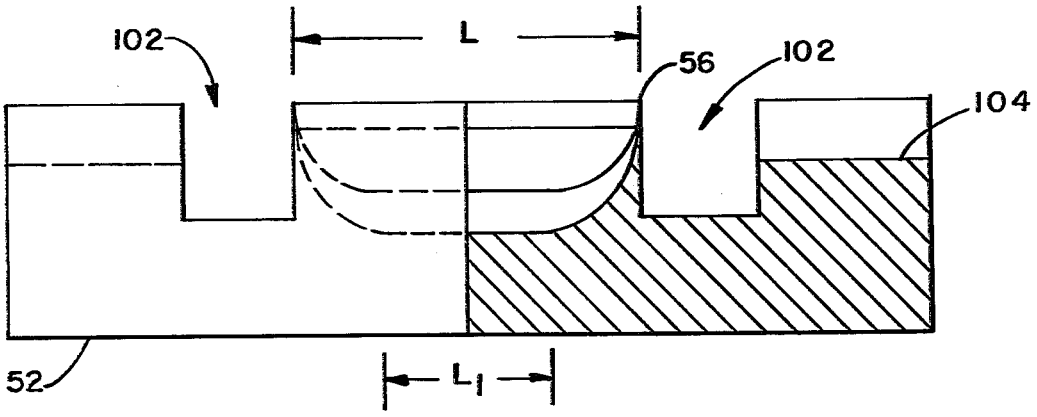
FIG. 10 is a side view partially in sections of one-half of a typical mold for producing the product of the present invention.
Figure 11:
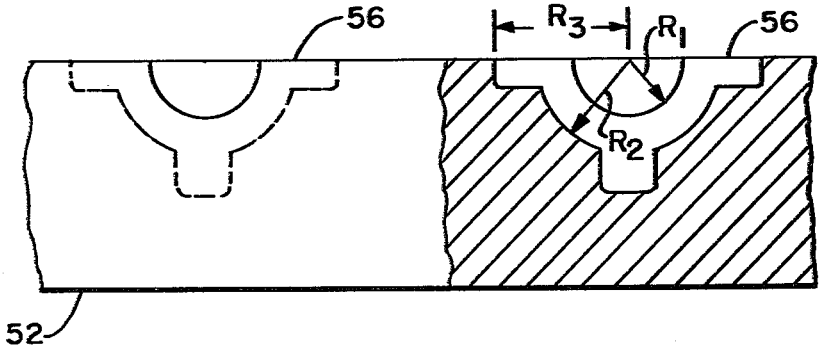
FIG. 11 is an end view partially in sections of a portion of a dual cavity mold in accordance with the present invention.

An alternative configuration which may be produced in accordance with the molding process of the present invention is shown in FIGS. 6 and 7 in which a scraper generally indicated at 80 and 90 of FIGS. 6 and 7, respectively, is composed of three or more blades designated 72 extending a distance B from the molded body 76 surrounding sucker rod 82 and attached by shrink fitting as a result of having been molded in place at boundary 74. The blades 72 have a thickness $b$ and an outer radius $R_3$ or one-half W, where W is the nominal diameter of the tubing. The molded body of such scraper has a minimum thickness $t$ which is the difference $R_2 - R_1$. The total scraper has a length L and an effective scraping edge $L_1$.

It is noted with respect to the above-described embodiment shown in FIGS. 6 and 7, as well as with regard to the especially preferred embodiment shown in FIGS. 3 and 4, that these scrapers having three or more points of contact with the tubing wall in configurations having the dimensional relationships set forth above may, in addition to acting effectively as scrapers, act as centralizers and insulators preventing electrolysis. It is also further noted that these features when embodied in a plastic scraper provide for a reduction of friction within the well and a resulting decrease in the power required to operate the well, as will be discussed in greater detail later in the specification.

Figure 8:
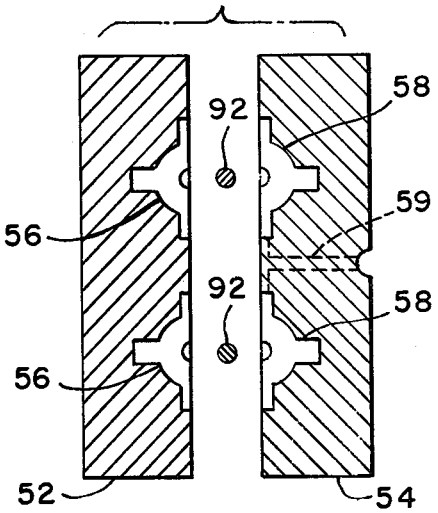
FIG. 8 is a schematic diagramatical representation showing the sucker rods in place prior to closing the moveable platen of a typical injection molding machine.

Turning our attention to the details of the molding process in accordance with the present invention, as illustrated by molds suitable for production of the especially preferred embodiment of the present invention as shown in FIGS. 3 and 4, it is noted that, as shown in FIG. 8, two sucker rods designated 92 are brought into and simultaneously positioned centrally in each of the respective mold cavities of a dual cavity mold in accordance with the present invention. The dual cavities are formed by the respective half molds designated 56 and 58 of the moveable and stationary platens designated 52 and 54, respectively.

When the moveable platens 52 is moved into a closed position with respect to stationary platen 54, the fluid plastic material is injected into the mold cavity via the array of orifices designated 59. The plastic material designated 94 is injected and extruded around and about sucker rods 92 which are clamped into place and held centrally within each of the dual mold cavities.

The details of a dual cavity mold for the production of molded scrapers of the especially preferred embodiment, FIGS. 3 and 4, is shown in FIGS. 10, 11, 12, and 13. In side view, FIG. 10, the mold configuration 56 of length L with scraping edge $L_1$ is cut into block 52 along with a passage for the rod 104 and two transverse slots 102 at each end of length L of the mold configuration 56.

Figure 13:
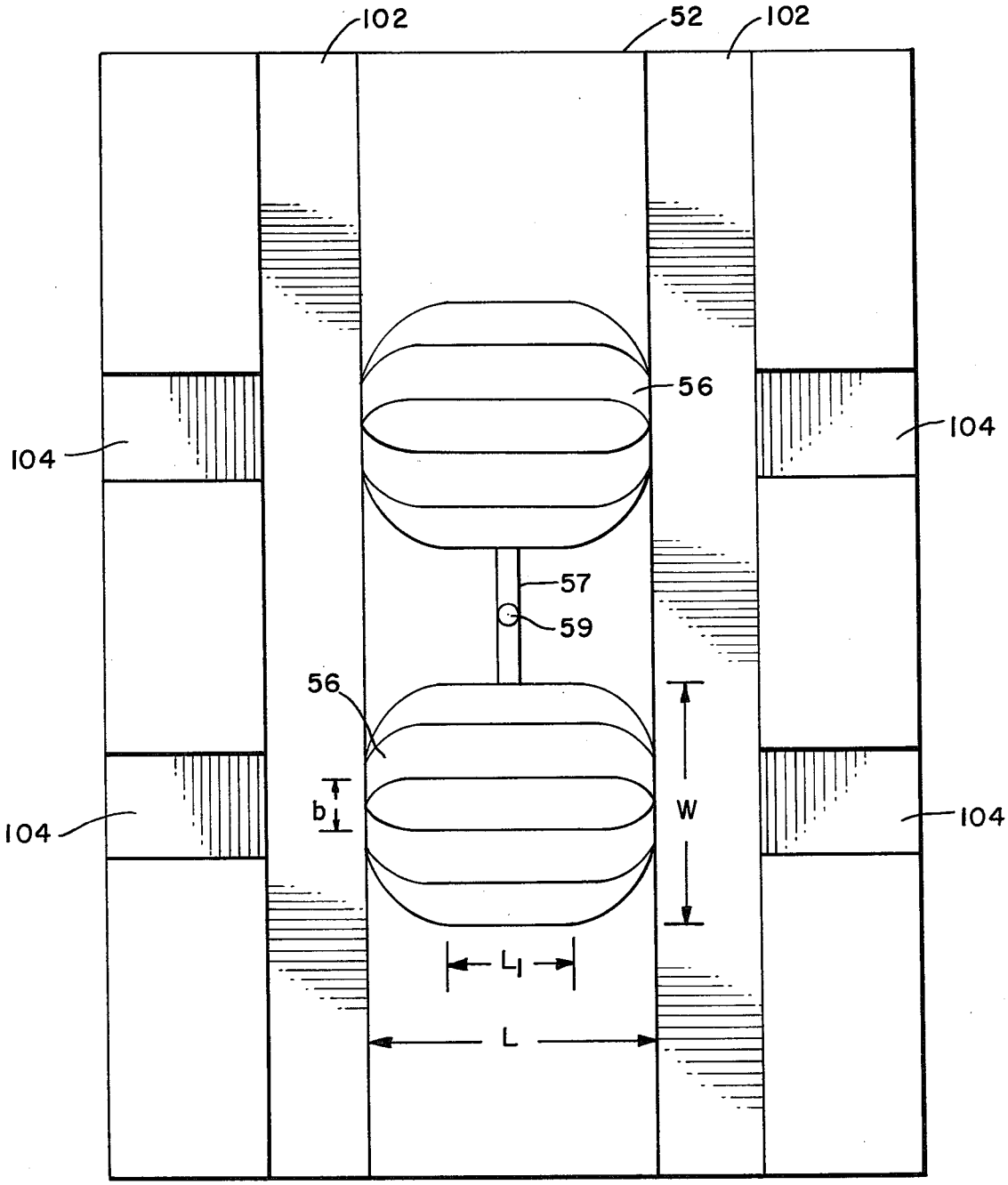
FIG. 13 is a top view of a dual cavity mold in accordance with the present invention.

As shown in FIG. 13, the dual cavities 56 are connected by a passage 57 to allow the fluid plastic from orifice 59 to enter each of the cavities.

Figure 12:
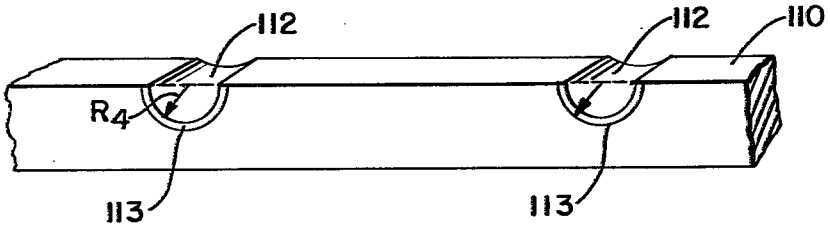
FIG. 12 is a perspective view of the operative portion of a rod size adjustment insert in accordance with the present invention.

It is possible by use of insert blocks 110 shown in FIG. 12 to use a single mold for any given tubing diameter for any and all conventionally employed rod sizes as may be associated with such tubing diameter. Block 110 has cut into it with radius $R_4$ corresponding to the radius of the rod to which the scraper is to be molded semi-circles 112 provided with a suitable taper 113 to allow a smooth transition to the mold configuration 56. Thus, merely by changing insert blocks 110, it is possible to mold from a single mold for a given tubing diameter onto any number of rod sizes each of which has a corresponding insert block 110 with a passage 112 corresponding to its radius to seal and close the ends of each of the dual cavities 56 of the mold.

Figure 14:
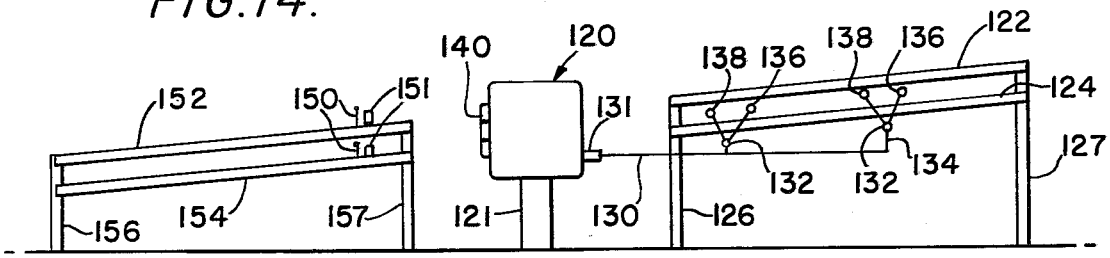
FIG. 14 is a schematic diagramatical representation of a material handling system in accordance with the present invention.
Figure 15:
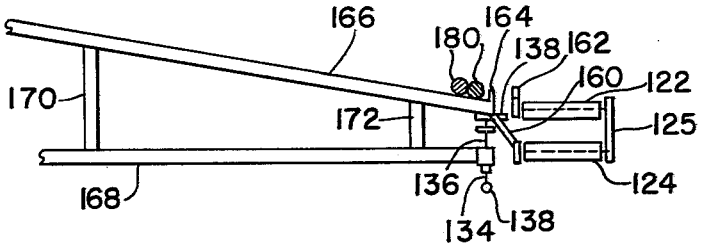
FIG. 15 is a cross-sectional view taken just prior to one of the tripping stations in the material handling system according to the present invention.

Carrying out of the above-described molding operations in the dual cavities mold is greatly facilitated by the material handling and conveying apparatus illustrated schematically in FIGS. 14 and 15. Rods 180 are fed from a storage rack down incline 166. Each rod in turn comes to be held by stopping detent 164 at the bottom of the incline structure 166 which is supported by support members 170, 172, and 168.

Pivotally mounted at 132 about element 168 is a tripping device consisting of angularly extending radial elements 136 and 138. In typical operation, as radial arm 136 is rotated forward; that is, in the direction of the molding machine or counterclockwise, by action of lever arms 130 and 134 which may be triggered automatically by suitable electrical or pneumatic means 131 or optionally by manual operation, the end of radial arm 136 lifts rod 180 above detent 164 and upon beginning its motion to return to its original position drops rod 180 with such assistance as may be necessary by guide member 160 onto the bed of roller conveying means 124.

Directly above this lower bed of roller conveying means supported by conventional support means 125 is an upper bed of roller conveying means 122. As radial arm 136 continues its operation and motion to return to its original position, the action of linkage 130 and lever arm 134 serves to rotate a second angularly disposed radial lever arm 138 in a clockwise direction to lift the next rod 180 in line up, not only over detent 164 but also over a detent guard rail 162 on the upper conveying track or bed of rollers. Detent and guard rail 126 served in the earlier sequence of operation to prevent the rod lifted by radial arm 136 which was lifted only high enough to clear detent 164 from being inadvertently placed on the upper bed of rollers 122. Now radial arm 138 being of greater length and/or having greater degree of rotation provided through the applied linkages may lift the rod 180 over both detents 164 and 162 to inevitably place it upon the upper bed of rollers 122. This action may be further assisted by having a T-shaped member of sufficient length at the end of radial arm 138 as to prevent any rod 180 resting on it from falling between radial arm 138 and guard rail 162 and, thus, inadvertently finding its way onto the lower rack of roller members in conveying track 124.

Conveying tracks 122 and 124 are inclined by support members 126 and 127 so that rods placed upon them will roll along the individual rollers under the force of gravity to the molding machine indicated schematically at 120 as supported by support element 121.

Upon completion of molding the first scrapers simultaneously on the two rods designated 180 which are present in the dual cavities of the mold within the injection molding machine 120, the rods are led upon the opening of the cavity through an excess and interconnecting material cutter designated generally at 140. The structure and operation of cutter 140 will be described in further detail in the paragraphs which follow.

Following the cutting of any excess material specifically including the interconnecting material formed in channel 57, shown in FIG. 13, from the newly molded scrapers, the rods and scrapers are led onto additional inclined roller conveyors 152 and 154 supported and inclined by support members 156 and 157. The conveyor means 152 and 154 may be augmented by the presence of distance measuring and detecting elements 150 and by automatically or sense-operated clamping and holding means 151 which may by automatic sensing or pre-sequenced timing, operate to hold the rods in a given position until the molding machine again clamps the rods in place or to allow for the passage of a predetermined length of rod prior to automatically stopping the rod in the desired position for application of the next scraper to the rod.

The operation and construction of such automatic or pre-timed stopping and holding mechanisms is, of course, well known in the art and does not as such form a part of the present invention although the employment of such means in combination with the other elements of the above-described system for molding plastic scrapers about sucker rods is a part of the present invention.

Figure 16:
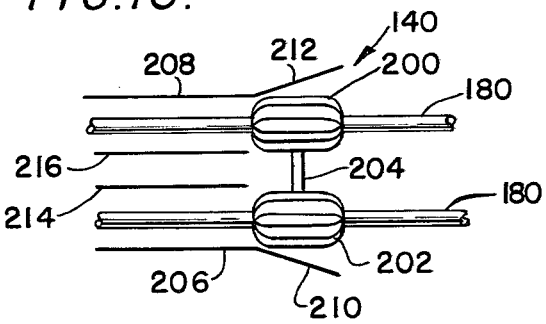
FIG. 16 is a side view of the cutting mechanism in accordance with the present invention.
Figure 17:
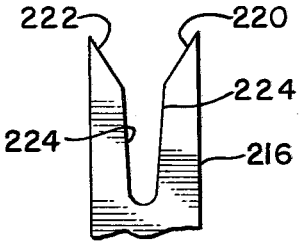
FIG. 17 is a top view of the cutter blades of the present invention.

The cutter mechanism generally designated 140 is shown in detail in FIGS. 16 and 17. As sucker rods 180 with newly molded scrapers 200, 202 molded thereon leave the molding machine, the molded scrapers 200 and 202 are connected by that plastic which was in the interconnecting channels of the mold at the termination of the molding operation. This interconnecting plastic 204 is trimmed off by the operation of twin cutter blades 214 and 216 as the molded scrapers are forced by guide elements 210 and 22 into the channel between guide elements 206 and 214 and 208 and 216, respectively. As will be noted from FIG. 17, transverse alignment with the cutting edges 224 of a blade, here shown as 216, is assured by the incline guide means 220 and 222.

As has been briefly alluded to above, molded scrapers produced from plastic materials of the class hereinafter described not only serve as excellent scrapers in the removal of paraffin from the tubing wall but also have such properties as insuring a tight frictional grip on the sucker rod without inducing stress or strain in the rod while at the same time showing wear characteristics on the order of ten times that of steel scrapers. It has been further noted that paraffin itself has no tendency to adhere to the plastic scrapers of the present invention.

Figure 18:
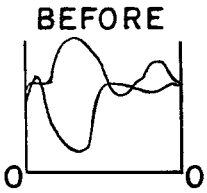
FIG. 18 is a work diagram showing the energy expended in pumping prior to installation of scrapers/centralizers of the present invention.
Figure 19:
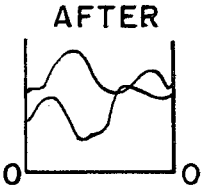
FIG. 19 is a work diagram showing the energy expended in pumping following installation of scrapers/centralizers in accordance with the present invention.

In addition to the above-described advantages, the plastic scrapers of the present invention act as centralizers and insulators preventing electrolysis and further serve to reduce friction within the tubing and reduce the power requirements of the well. A comparison of FIG. 19 with that of FIG. 18 shows the reduction both in peak forces encountered and in total energy expended after the application of molded plastic scrapers and centralizers of the present invention as compared with the forces encountered and energy required in the operation of the well with plain unscrapered rods.

Figure 20:
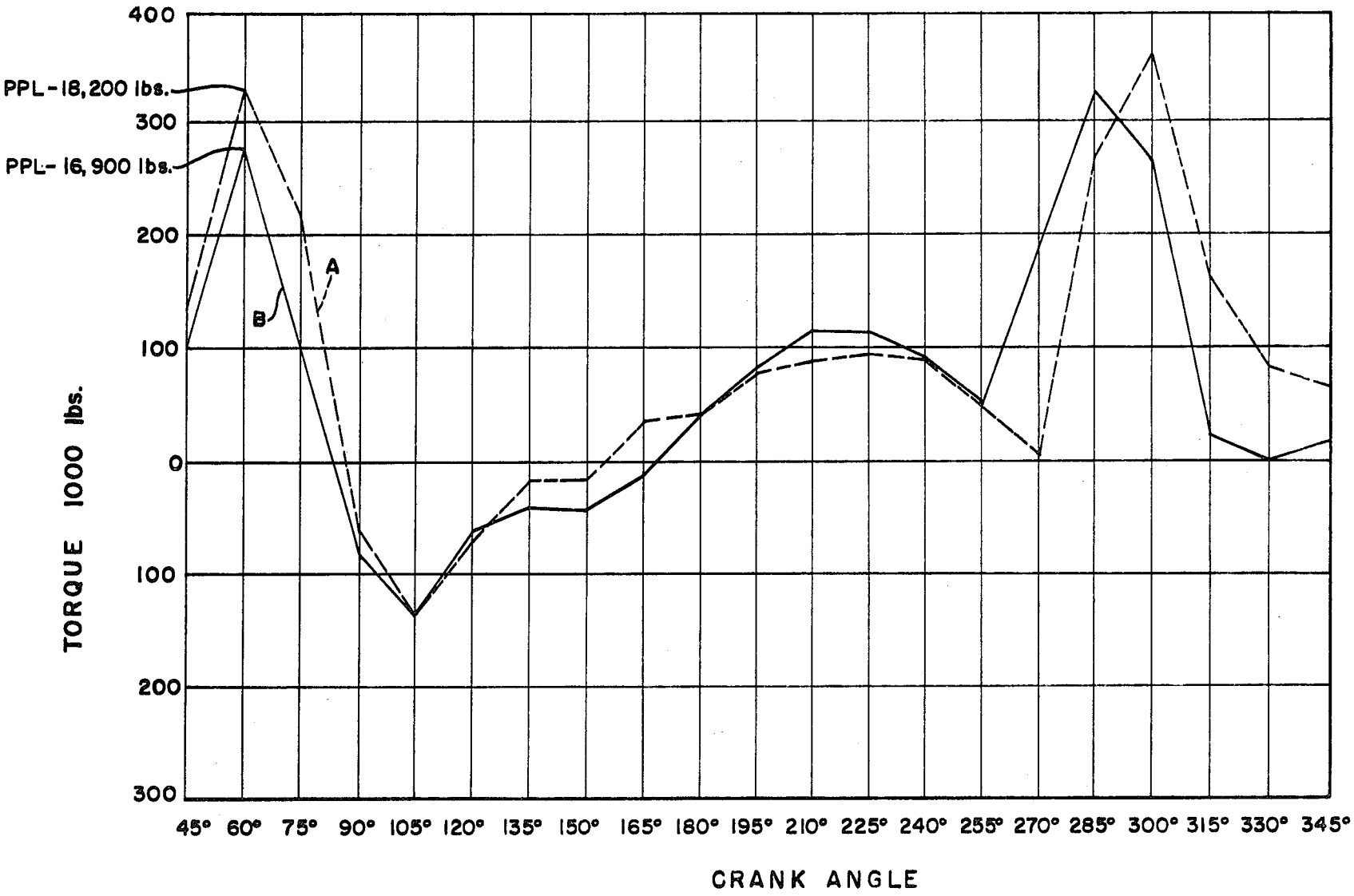
FIG. 20 shows calculated torque data from an actual working well operated with plain rods and rods having scrapers in accordance with the present invention.

FIG. 20 shows calculated torque data comparing both the peak load requirements and operation throughout the cranking cycle of plain, unscrapered rods shown by curve A in dotted line form and by curve B illustrating the reduction in torque obtained using a string of scrapers/centralizers in accordance with the present invention in a problem paraffin well.

Figure 21:
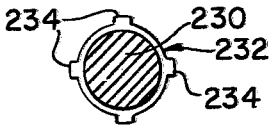
FIG. 21 is a cross-sectional representation of the modification of the sucker rod for optional use in accordance with the present invention.

FIG. 21 shows an optional auxiliary clamping ring designated 232 which may be welded or otherwise firmly and securely attached at various points corresponding to the position of scraper addition to sucker rods 230. Such clamps or clips as 232 preferably consist of sandblasted bodies and/or rings having raised or barbed portions 234. Such rings 232 may optionally be employed by being placed on the sucker rod 230 and thereafter injection molding a scraper of desired configuration over and about said clamp and the sucker rod. Such clamping means 232 serve to further increase the resistance of the molded plastic scraper to move on the sucker rod.

While it is the usual and preferred practice to employ scrapers of the configuration and type described above on rotated sucker rods, it has been found that effective cleaning and cutting action may be obtained without the employment of rotation in certain cases where the cutting action of the scraper blade of the present invention as its reciprocates within the oil well tubing is sufficient to break loose substantial quantities of any paraffin tending to accumulate in sufficient quantity to cause serious problems.

Figure 22:
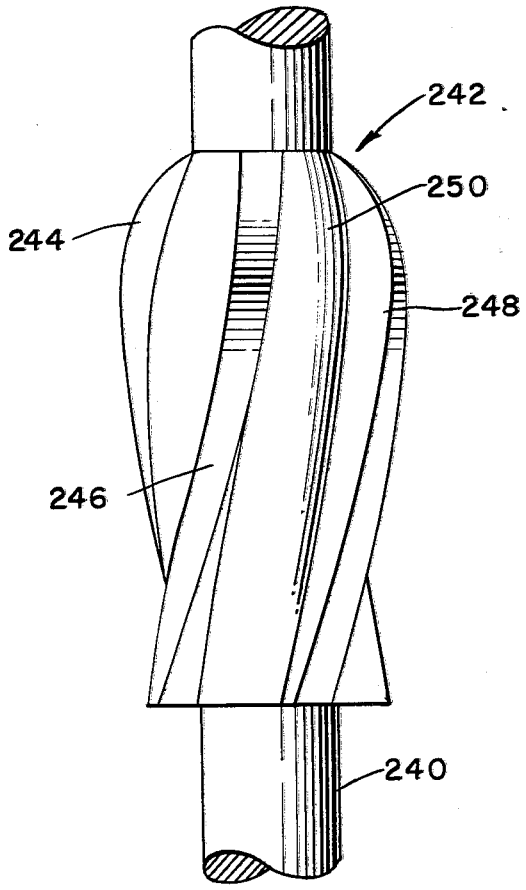
FIG. 22 shows a spiral scraper produced in accordance with the present invention for utilization in non-rotated rod installations.

However, for those not wishing to rotate their sucker rods but requiring total area coverage to prevent paraffin problems, a spiral configuration of molded plastic, as shown in FIG. 22, may be employed.

In this embodiment, a molded plastic scraper designated generally at 242 is injection molded about sucker rod 240 in a manner as described above and having a configuration as shown for example in FIGS. 3 and 4.

Immediately upon removal of the scraper from the mold, while it is still hot and in a semi-plastic condition, one end of the scraper is firmly grasped and rotated through an angle of from 60° to 90° with respect to the other fixed end. Alternatively, each end may be rotated in opposite directions to achieve the desired angular displacement resulting in the blades 244, 246, and 248 of scraper 242 and to some extent the plastic material within the body 250 being formed into a helical array in which the bottom end of each blade overlaps or is tangential to the vertical projection of the top portion of the next adjacent blade in the direction of rotation.

Alternative scrapers should preferably be rotated in opposite directions to prevent torque.

Figure 23:
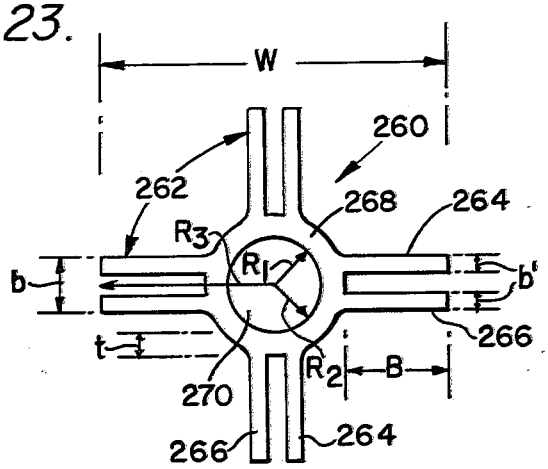
FIG. 23 is a cross-sectional representation of yet another embodiment of the scraper/centralizer in accordance with the present invention.

A further embodiment of the especially preferred embodiment of FIGS. 3 and 4 is shown in the top view designated FIG. 23. This configuration obtained by inserting a blade-like element in the mold centrally disposed in each of the scraper blades results in the configuration shown and designated generally at 260 in which each blade 262 is slotted into two blades each having a thickness $b'$ where $b' + b'$ is less than $b$ and the depth of the groove separating the individual blade elements 264 and 266 is approximately B which corresponds to the dimension of the blade extending beyond the main body of molded material 268 surrounding sucker rod 270. As in the previous embodiments, the minimum thickness of molded material $t$ surrounding the sucker rod is the difference of $R_2 - R_1$ and the total blade radius is $R_3$ which is one-half the nominal diameter of the tubing W.

The preferred plastic materials to be employed in the present invention are the thermoplastic polyamides or nylon resins such as Zytel® Nylon Resins produced and sold by DuPont. Nylons designated Type 6/10, 6/6, and 6 by the 1971–1972 *Modern Plastics Encyclopedia* may be employed in the present invention.

Molded scrapers of these materials require from 1,800 to 2,200 pounds force to cause the scraper to move on the rod. This firm frictional grip is obtained as a result of these materials shrinkage of about 0.015 inch-inch/inch and the fact that these materials tend to absorb moisture from the environment up to about 2.5 – 8% with a further corresponding increase in dimensions and tightness of fit.

Other plastic materials having similar "shrinkage" properties and tensile strengths may be employed if not too brittle on molding and if their abrasion and wear characteristics are satisfactory. It should also be noted that such plastics must be able to withstand a wide range of temperature conditions found in oil well operations involving temperatures from −40° to +400° F.

Other suitable plastic materials include the glass and mineral filled nylons such as disclosed in U.S. Pat. No. 3,419,517 and specifically including those employing clays and sodium aluminiosilicates of the types described in U.S. Pat. Nos. 3,567,680; 3,290,165; 3,328,125; 3,328,124; 2,848,346; and 2,739,073.

Other plastic materials in addition to the above-mentioned polyamides which may be usefully employed within the scope of the present invention include polyacetal, polyvinylidene chloride, polyester diallylphthalate, polytetra fluoro ethylene, polychloro-trifluoro ethylene, and polymethyl alpha chloroacrylate, and the like, and blends thereof.

The dimensions of the scraper/centralizier and their relative relationships have been found critical.

On one hand, it is necessary to mold sufficient plastic to the rod to provide a firm grip requiring on the order of from 15,000 to 20,000 psi to move the molded scraper on the rod, and it is further necessary to provide sufficient wearing and scraping surface for the scraper/centralizer to be effective.

On the other hand, it is desirable to restrict the fluid flow as little as possible.

Balancing these considerations, it has been found that where rods of the following diameters are employed in the specified diameter tubing a minimum molded thickness, $t$, of from 0.25 – 0.375 inches is required:

| Tube Diameter | Rod Diameters |
|---|---|
| 1.5" | 0.5 –0.625" |
| 2" | 0.5 –0.875" |
| 2.5" | 0.625–1.0" |
| 3" | 0.75 –1.0" |

Also under these conditions, it is desirable to provide a scraping surface of width, $b$, of from 0.5 to 0.625 inch and an effective length of $L_1$ of from 1 – 4.5 inches with a total length, L, of 3 to 6 inches.

In summary, the molded plastic scrapers of the present invention minimize the problem of rod, tubing, and scraper wear and assure paraffin build-up is virtually eliminated. The present invention is designed specifically for the problem hole where severe wear occurs between the tubing, rods, and/or scrapers causing much costly downtime. Used in conjunction with a rod rotator, it serves a dual purpose: as a paraffin scraper and as a rod centralizer, thus minimizing both the paraffin accumulation within the tubing and wear on the scrapers and rod coupling.

Various changes and modifications may be effected in the illustrated embodiments of the invention without departing from the scope or spirit of the invention defined in the appended claims.

What is claimed is:

1. An improved sucker rod having at least one molded paraffin scraper/rod centralizer thereon, comprising: a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychloro-trifluoro ethylene, polymethyl alpha chloroacrylate having a shrinkage factor of about 0.01 inch-inch per inch whereby upon cooling and solidifying the rod centralizer firmly grips the rod so tightly that a force in excess of 1800 pounds is required to cause said centralizer to move on the rod, the rod centralizer being formed with a central body and radially extending blade means disposed about the central body, said blade means presenting a scraping edge and contact surface for respectively preventing paraffin build-up and bearing the forces encountered in centralizing and scraping and having inwardly sloping surfaces at the top and bottom thereof.

2. An improved sucker rod having at least one molded paraffin scraper/rod centralizer thereon, comprising, a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychlora-trifluoro ethylene, polymethyl alpha chloroacrylate having a shrinkage factor of about 0.01 inch-inch per inch whereby upon cooling and solidifying the rod centralizier firmly grips the rod so tightly that a force in excess of 1800 pounds is required to cause such centralizer to move on the rod, the rod centralizer being formed with a central body and at least two radially extending blade means disposed about the central body, each of said blade means having a helical configuration and presenting a scraping edge and contact surface for respectively preventing paraffin build-up and bearing the forces encountered in centralizing and scraping and having inwardly sloping surfaces at the top and bottom thereof.

3. An improved sucker rod having at least one molded paraffin scraper/rod centralizer thereon, comprising, a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychlora-trifluoro ethylene, polyemthyl alpha chloroacrylate having a shrinkage factor of about 0.01 inch-inch per inch whereby upon cooling and solidifying the rod centralizer firmly grips the rod so tightly that a force in excess of 1800 pounds is required to cause such centralizer to move on the rod, the rod centralizer being formed with a molded central body having a minimum thickness of from 0.025 to 0.0375 inches and at least three radially extending blades, each of which has an effective scraping edge and contact surface of from 1.0 to 4.5 inches and a thickness of from 0.5 to 0.625 inches, each of the rod centralizers having an individual total length of 3 to 6 inches and in which the ratio of tube diameter to rod diameter is from 2.2 to 4.1.

4. An improved sucker rod having at least one molded paraffin scraper/rod centralizer thereon, comprising, a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychlora-trifluoro ethylene, polymethyl alpha chloroacrylate having a shrinkage factor of about 0.01 inch-inch per inch whereby upon cooling and solidifying the rod centralizer firmly grips the rod so tightly that a force in excess of 1800 pounds is required to cause such centralizer to move on the rod, the rod centralizer being formed with a central body and four radially extending blades disposed about the central body, said blade means presenting a scraping edge and contact surface for respectively preventing paraffin build-up and bearing the forces encountered in centralizing and scraping and having inwardly sloping surfaces at the top and bottom thereof.

5. An improved sucker rod having at least one molded paraffin scraper/rod centralizer thereon, comprising: a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychloro-trifluoro ethylene, polymethyl alpha chloroacrylate having a shrinkage factor of about 0.01 inch-inch per inch whereby upon cooling and solidifying the rod centralizer firmly grips the rod so tightly that a force in excess of 1800 pounds is required to cause said centralizer to move on the rod, and wherein shrink fitting said rod centralizer in place around said sucker rod induces an increased stress said paraffin scraper/rod centralizer without appreciably increasing the strain in said paraffin scraper/-rod centralizer, the rod centralizer being formed with a central body and radially extending blade means presenting a scraping edge and contact surface for respectively preventing build-up and bearing the forces encountered in centralizing and scraping and having inwardlu sloping surfaces at the top and bottom thereof.

6. An improved sucker rod having at least one molded paraffin scraper/rod centralizer thereon, comprising: a rod and a rod centralizer formed about the rod at a selected point along the length of the rod by the process of injection molding and shrink fitting in palce said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallyphthalate, polytetra fluora ethylene, polychlora-trifluoro ethylene, polymethyl alpha chloroacrylate having a shrinkage factor of about 0.01 inch-inch per inch whereby upon cooling and solidifying the rod centralizer firmly grips the rod so tightly that a force in excess of 1800 pounds is required to cause such centralizer to move on the rod, and wherein shrink fitting said rod centralizer in place around said sucker rod induces an increased stress said paraffin scraper/rod centralizer without appreciably increasing the strain in said paraffin scraper/rod centralizer, the rod centralizer being formed with a central body and radially extending blade means disposed about the central body, each of said blade means having a helical configuration and presenting a scraping edge and contact surface for respectively preventing paraffin build-up and bearing the forces encountered in centralizing and scrapping and having inwardly sloping surfaces at the top and bottom thereof.

7. An improved sucker rod having at least one molded paraffin scraper/rod centralizer thereon, comprising: a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychlora-trifluoro ethylene, polymethyl alpha chloroacrylate having a shrinkage factor of about 0.01 inch-inch per inch whereby upon cooling and solidifying the rod centralizer firmly grips the rod so tightly that a force in excess of 1800 pounds is required to cause such centralizer to move on the rod, and wherein shrink fitting said rod centralizer in place around said sucker rod induces an increased stress said paraffin scraper/rod centralizer without appreciably increasing the strain in said paraffin scraper/rod centralizer, the rod centralizer being formed with a molded central body having a minimum thickness of from 0.025 to 0.0375 inches and at least three radially extending blades, each of which has an effective scraping edge and contact surface of from 0.5 to 0.625 inches, each of the rod centralizers having an individual total length of 3 to 6 inches and in which the ratio of tube diameter to rod diameter is from 2.2 to 4.1.

8. An improved sucker rod having at least one molded paraffin scraper/rod centralizer thereon, comprising: a rod and a rod centralizer formed about the rod at a selected point along the length of the rod by the process of injection molding and shrink fitting in place said rod centralizer, said rod centralizer consisting of thermoplastic polyamides, nylon resins including Zytel nylon, nylon resins designated type 6/10, 6/6 and 6 by the 1971–1972 Modern Plastics Encyclopedia, polyacetal, polyvinylidene chloride, polyester, diallylphthalate, polytetra fluora ethylene, polychlora-trifluoro ethylene, polymethyl alpha chloroacrylate having a shrinkage factor of about 0.01 inch-inch per inch whereby upon cooling and solidifying the rod centralizer firmly grips the rod so tightly that a force in excess of 1800 pounds is required to cause such centralizer to move on the rod, and wherein shrink fitting said rod centralizer in place around said sucker rod induces an increased stress said paraffin scraper/rod centralizer without appreciably increasing the strain in said paraffin scraper/rod centralizer, the rod being formed with a central body and four radially extending blades disposed about the central body, said blade means presenting a scraping edge and contact surface for respectively preventing paraffin buildup and bearing the forces encountered in centralizing and scraping and having inwardly sloping surfaces at the top and bottom thereof.

* * * * *

UNITED STATES PATENT AND TRADEMARK OFFICE

CERTIFICATE OF CORRECTION

PATENT NO. : 4,088,185

DATED : May 9, 1978

INVENTOR(S) : Forrest Leon Carson

It is certified that error appears in the above-identified patent and that said Letters Patent are hereby corrected as shown below:

Col. 2, lines 26 and 29-30; change "applicants" to -- applicant --.

Col. 4, line 1; change "diagramatical" to -- diagrammatical --.

Col. 10, lines 2 and 3; change "diallylphthalate" to -- dialkylphthalate --.

Col. 10, line 19; change "inches" to -- inch --.

Col. 10, line 56;
Col. 11, lines 12, 36 and 61;
Col. 12, lines 16, 42; and,
Col. 13, line 2; change "diallylphthalate" to -- dialkylphthalate --.

Col. 10, line 58;
Col. 11, lines 13, 37 and 62;
Col. 12, lines 17 and 43;
Col. 13, line 3; and,
Col. 14, line 7; change "fluora" to -- fluoro --.

Col. 11, line 13; change "polychlora" to -- polychloro --.

Col. 11, line 38; change "polyemthyl" to -- polymethyl --.

Col. 11, lines 45 and 48; change "inches" to -- inch --.

Col. 12, line 25;
Col. 13, line 10; and,
Col. 14, line 14; following "stress" insert -- on --.

Col. 12, line 32; change "inwardlu" to -- inwardly --.

Col. 12, line 37; change "palce" to -- place --.

UNITED STATES PATENT AND TRADEMARK OFFICE

CERTIFICATE OF CORRECTION

PATENT NO. : 4,088,185

DATED : May 9, 1978

INVENTOR(S) : Forrest Leon Carson

It is certified that error appears in the above-identified patent and that said Letters Patent are hereby corrected as shown below:

Col. 12, line 50; following "stress" insert -- on --.

Col. 12, line 59; change "scrapping" to -- scraping --.

Col. 13, lines 15 and 17; change "inches" to -- inch --.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*